US007048315B2

(12) United States Patent
Wong

(10) Patent No.: US 7,048,315 B2
(45) Date of Patent: May 23, 2006

(54) LOCK FOR LEVER-HANDLED DOOR LATCH

(75) Inventor: Anthony Wong, Franklin, MA (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/463,683

(22) Filed: Jun. 17, 2003

(65) Prior Publication Data

US 2004/0256862 A1 Dec. 23, 2004

(51) Int. Cl.
*E05C 19/18* (2006.01)

(52) U.S. Cl. ..... 292/297; 292/298; 292/336.3

(58) Field of Classification Search ..... 292/336.3, 292/DIG. 2, 290, 297, 298; 70/432, 436, 70/441, 179, 180, 207, 209, 210, 211
See application file for complete search history.

(56) References Cited

U.S. PATENT DOCUMENTS

| | | | | |
|---|---|---|---|---|
| 2,178,378 A | | 10/1939 | Schlage | |
| 2,348,265 A | | 5/1944 | Rippingille | |
| 2,883,868 A | | 4/1959 | Fresard et al. | |
| 2,939,308 A | * | 6/1960 | Trammell, Jr. | 70/210 |
| 3,452,616 A | | 7/1969 | Nelson et al. | |
| 3,716,261 A | | 2/1973 | Gerlach | |
| 3,808,850 A | * | 5/1974 | Walters | 70/215 |
| 4,078,449 A | | 3/1978 | Kelly | |
| 4,196,602 A | * | 4/1980 | Akselsen | 70/211 |
| 4,404,826 A | | 9/1983 | Brill | |
| 4,673,202 A | * | 6/1987 | Willis | 292/162 |
| 4,947,663 A | | 8/1990 | Yeager | |
| 5,067,334 A | | 11/1991 | Sorkilmo | |
| 5,193,373 A | * | 3/1993 | Hunt | 70/416 |
| 5,303,965 A | | 4/1994 | Meehan | |
| 5,313,812 A | * | 5/1994 | Eklund et al. | 70/416 |
| 5,327,632 A | | 7/1994 | Moore | |
| 5,579,804 A | * | 12/1996 | Roberts | 137/385 |
| 5,651,279 A | | 7/1997 | Berton et al. | |
| 6,105,406 A | * | 8/2000 | Thompson et al. | 70/416 |

FOREIGN PATENT DOCUMENTS

DE 292348 * 5/1914

* cited by examiner

*Primary Examiner*—Gary Estremsky
(74) *Attorney, Agent, or Firm*—Barnes & Thornburg LLP

(57) ABSTRACT

A door lock is provided for use with a door handle having a lever movable about a shaft extending perpendicularly to the lever and connected to a latch mechanism which controls the opening and closing of a door. The lock includes a housing configured to be coupled to the door handle and a blocking member movable relative to the housing between a lever-blocking position blocking movement of the lever to prevent opening of the door and a lever-releasing position permitting movement of the lever to permit opening of the door. From the lever-blocking position, the blocking member is moved to the lever-releasing position by first pushing the blocking member inwardly against a spring to free the blocking member, and then moving the blocking member relative to the housing.

21 Claims, 6 Drawing Sheets

LOCK FOR LEVER-HANDLED DOOR LATCH

BACKGROUND AND SUMMARY

The present disclosure relates to a lever-handled door latch, and in particular to a lock for a lever-handled door latch. More particularly, the present disclosure relates to a door handle assembly of the type having a lever movable about the axis of a shaft extending generally perpendicularly to the lever and connected to a latch mechanism which controls the opening and closing of the door.

Door locks are often required to prevent children from entering a restricted area, such as a bathroom, basement, or bedroom. It is desired to provide a door lock for a lever-handled door latch that can be anchored readily to the door handle assembly for selectively blocking movement of the lever to, in turn, prevent opening of the door.

A lock in accordance with the present disclosure is provided for use with a lever which moves a latch mechanism. The lock comprises a housing adapted to be coupled to the lever-latch mechanism assembly and a blocking member movable relative to the housing. A user can move the blocking member relative to the housing between its blocking position and its releasing position to control locking and unlocking of the lock.

Illustratively, the door lock may be provided for use with a door handle of the type having a hub concentric with an axis extending perpendicularly to the door and a laterally extending lever movable about the axis. The door lock includes a housing adapted to be coupled to the door handle and formed to have a track. The blocking member is movable in the track between a "blocking" position blocking movement of the lever to prevent opening of the door and a "releasing" position permitting movement of the lever to permit opening of the door.

The blocking member is movable in the track by pushing inwardly against a spring to free the blocking member for movement, and then moving the blocking member in the track. The track may be linear or curved. The housing may comprise portions which extend between the door and an escutcheon plate of the lever-latch mechanism assembly secured to the door by screws which typically hold the plate to the door.

The door lock, therefore, comprises a blocking member which is movable between its blocking position and its releasing position, and which is disposed on a housing which is mounted easily on a conventional door handle assembly. The blocking member may be movable relative to the housing, and supported for such movement by various mechanisms including pivot, slide, and the like.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
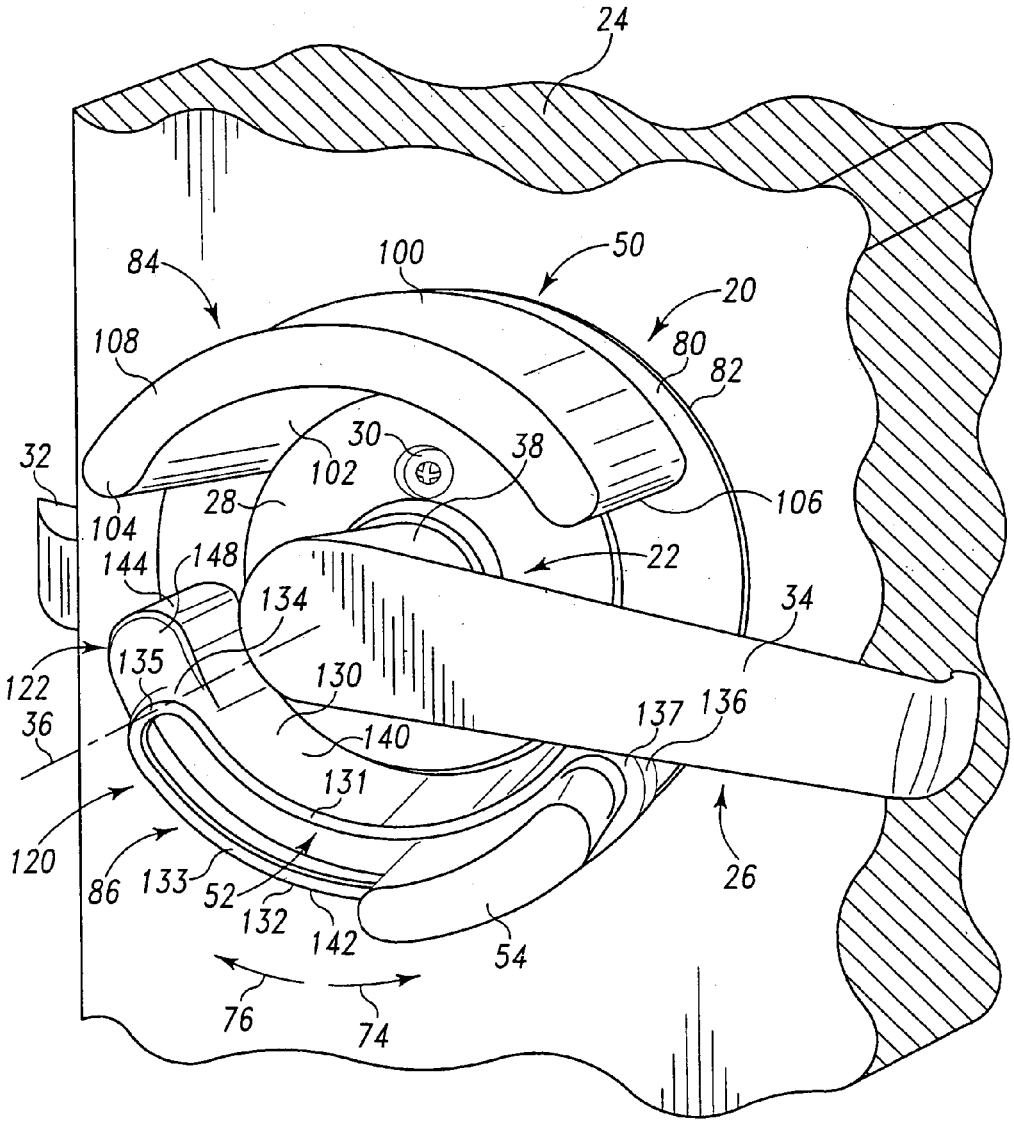
FIG. 1 is a perspective view of an illustrative door lock for use with a door handle assembly mounted on a door and configured to include a door handle having a laterally-extending lever pivotable about a shaft extending generally perpendicularly to the lever and connected to a latch mechanism which controls the opening and closing of the door, and showing the door lock including a housing mounted on the door to receive the door handle and a blocking member moved in an arcuate track formed in the housing to assume a blocking position to block movement of the lever in a clockwise direction so as to prevent opening of the door.
Figure 2:
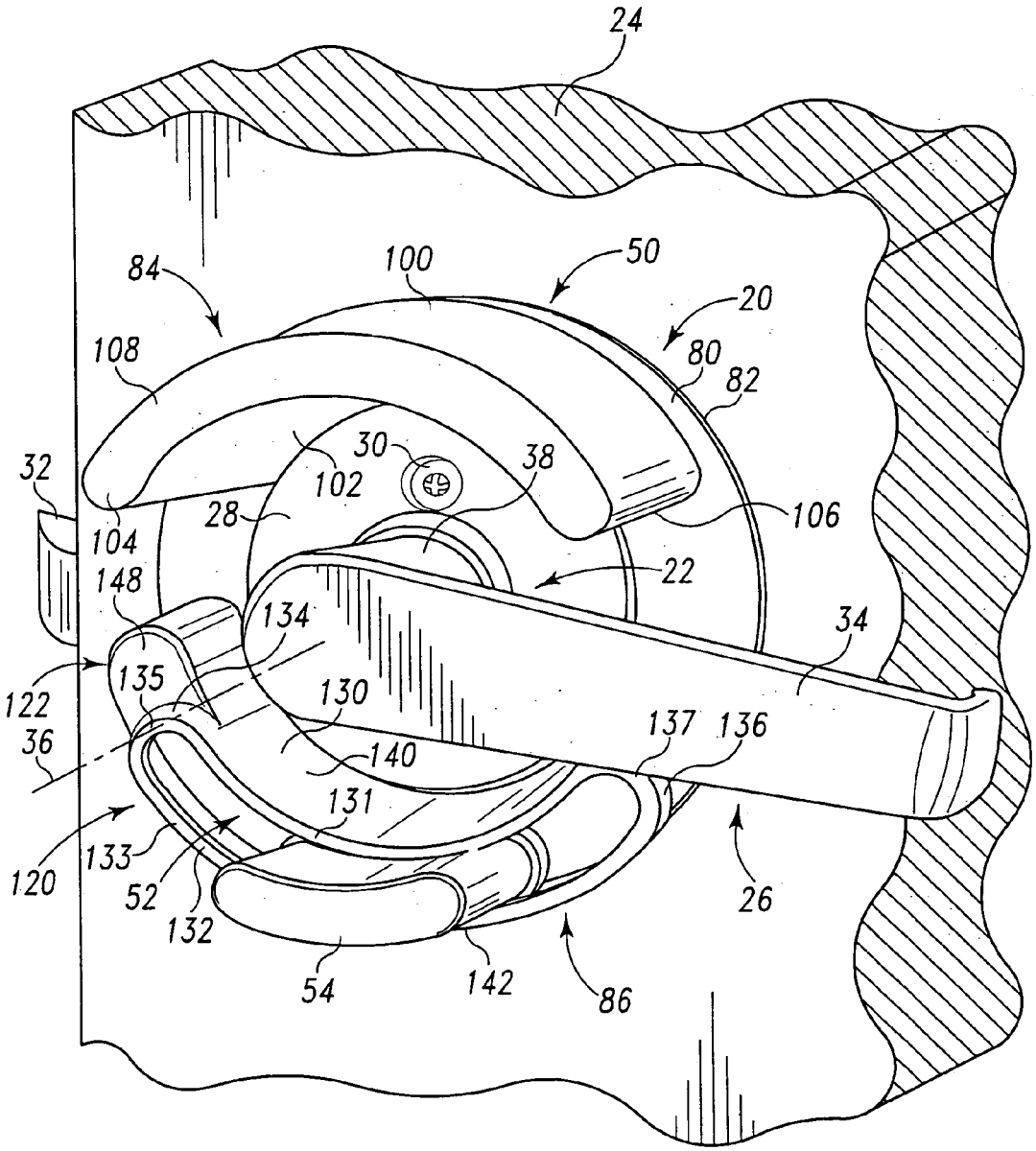
FIG. 2 is a perspective view similar to FIG. 1, and showing the blocking member moved in a clockwise direction in the arcuate track to a releasing position to permit movement of the lever so as to allow opening of the door.

Referring to FIGS. 1 and 2, there is shown a door lock 20 for use with a lever-type door handle assembly 22 mounted on a door 24. Door lock 20 includes a blocking member 54 that is moved relative to a housing 50 to assume a "locked" or lever-blocking position in FIG. 1 and an "unlocked" or lever-releasing position in FIG. 2.

Door handle assembly 22 includes a door handle 26, an escutcheon plate 28 secured to the door 24 by a pair of mounting screws 30, and a latch mechanism 32 which controls the opening and closing of door 24. Door handle 26 includes a laterally-extending right-handed lever 34 movable about an axis 36 of a hub 38 that extends generally perpendicular to lever 34 and connects to latch mechanism 32. Hub 38 is sometimes referred to herein as the shaft. Lever 34 is mounted for movement in a plane extending generally parallel to door 24 and perpendicular to axis 36 of shaft 38. Door lock 20 can be anchored readily to escutcheon plate 28 using the same mounting screws 30 that are used for mounting door handle assembly 22 to the door 24.

Door lock 20 includes a housing 50 having an arcuate track 52 and a blocking member 54, illustratively in the form of a post, mounted in the arcuate track 52 for side-to-side or lateral movement between a lever-blocking position shown in FIG. 1 to prevent movement of lever 34 to, in turn, prevent opening of door 24 and a lever-releasing position shown in FIG. 2 to permit movement of lever 34 to, in turn, allow opening of door 24. The centerline of blocking member 54 is at about 5 o'clock position in the lever-blocking position, and at about 6 o'clock position in the lever-releasing position. When blocking member 54 is in the lever-blocking position, blocking member 54 must be first pushed inwardly against a set of springs 58 by an operator to free blocking member 54 for lateral movement in track 52, and then blocking member 54 can be moved sideways by the operator to the lever-releasing position.

Although door handle assembly 22 shown in FIG. 1 has a right-handed lever 34, door lock 20 works equally well with a door handle assembly having a left-handed lever. For a left-handed lever, the centerline of blocking member 54 is on the opposite side of door handle assembly 22 at about 7 o'clock position in the lever-blocking position. The lever-releasing position of blocking member 54 remains the same at about 6 o'clock position for both the right-handed and left-handed levers.

In this disclosure, the terms "front", "raised", "advanced", "upward", "top", "forward" and the like terms mean away from the door 24. The terms "back", "depressed", "lowered", "retracted", "backward", "downward", "bottom", "behind", "rear" and the like terms toward door 24. The terms "lateral", "side-to-side", "sideways" and the like terms generally mean in a plane parallel to door 24 and perpendicular to axis 36. The terms "axial", "toward and away from the door" and like terms generally mean in a direction perpendicular to door 24 and parallel to axis 36. The terms "track", "channel", "pivot", and like terms mean any guide for guiding the movement of blocking member 54.

Figure 3:
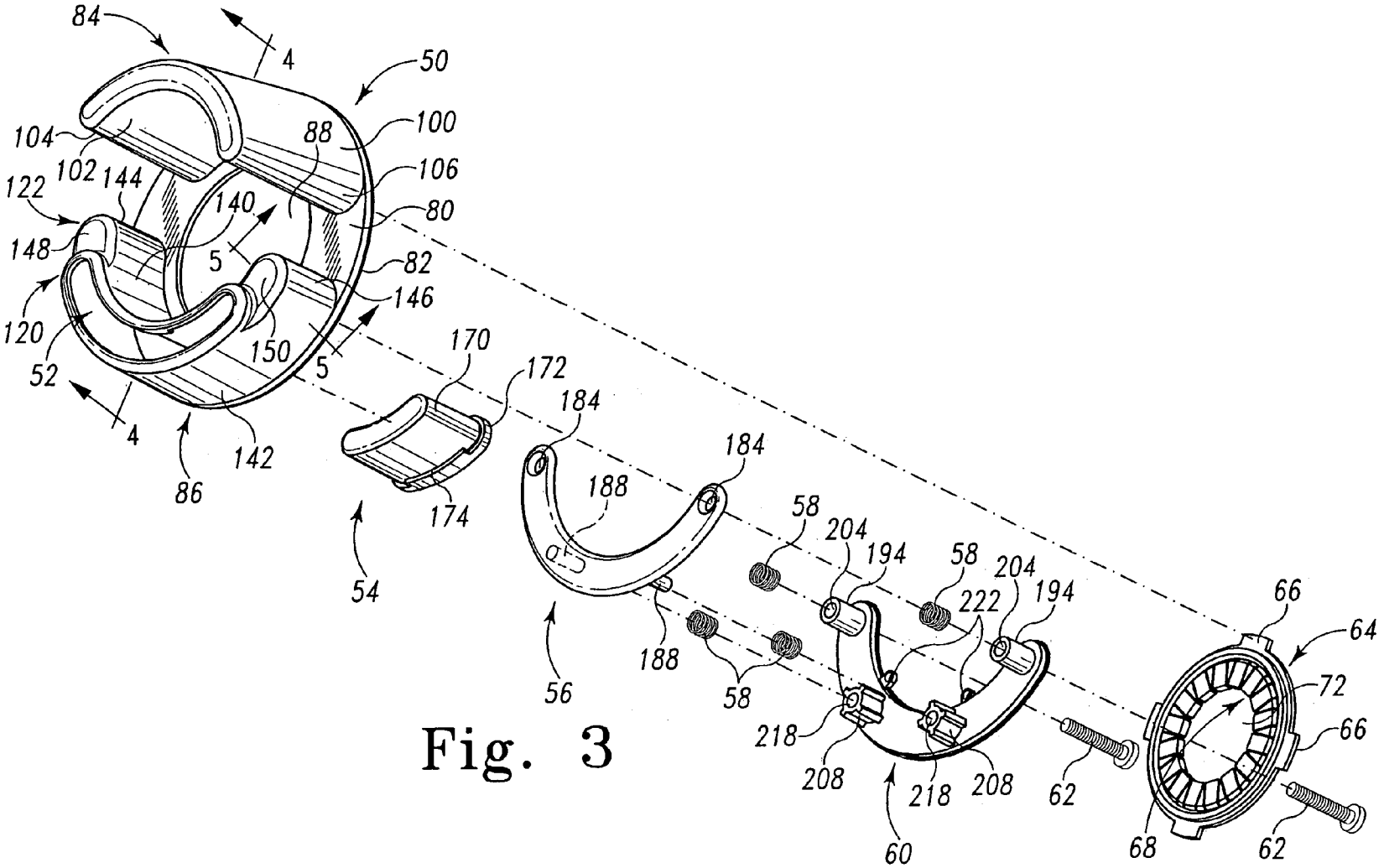
FIG. 3 is an exploded, perspective, assembly view of the door lock of FIGS. 1 and 2 showing a housing having an arcuate track, a blocking member sized to move in the arcuate track, an arcuate spring plate, four springs for biasing the spring plate to load the blocking member, an arcuate rear cover plate, a pair of mounting screws for securing the rear cover plate to the housing, and a mounting plate for anchoring the door lock to the door handle assembly mounted on the door.

As shown in FIG. 3, door lock 20 further includes arcuate spring plate 56, four springs 58, arcuate rear cover plate 60, two retaining screws 62, and an annular mounting plate 64. Housing 50, arcuate track 52, and blocking member 54 are also sometimes referred to as body 50, channel 52, and blocking post or locking button 54, respectively. The track 52 may be in the form of a channel or a rail in its cross sectional view.

As shown in FIG. 1, blocking member 54 is mounted in track 52 for side-to-side movement in either counterclockwise direction 74 or clockwise direction 76 and for axial movement toward and away from door 24. Blocking member 54 moves laterally between the lever-blocking position shown in FIG. 1 and the lever-releasing position shown in FIG. 2. The lever-blocking and lever-releasing positions are sometimes referred to herein as the locking and operating positions respectively.

Figure 6:
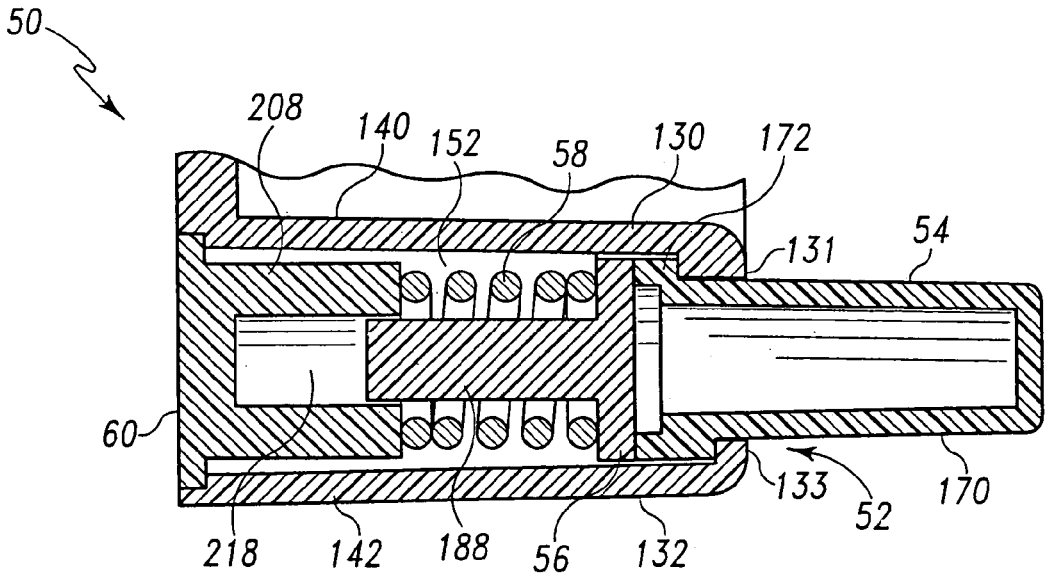
FIG. 6 is a partial sectional view similar to FIG. 5, and showing the blocking member mounted in the track for movement toward and away from the door, the spring plate being mounted for movement behind the blocking member, the rear cover plate being secured to the housing, and a spring extending between the spring plate and the rear cover plate to bias the blocking member forwardly.
Figure 7:
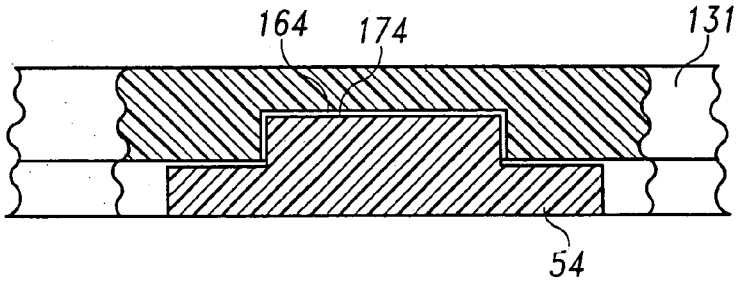
FIG. 7 a sectional view, partly broken away, showing a lug of the blocking member received in a recess in the arcuate track when the blocking member is in the blocking position.

As shown in FIG. 6, spring plate 56 is mounted behind blocking member 54 in a rearwardly facing cavity 152 formed in housing 50 for movement toward and away from door 24. Four springs 58 bias spring plate 56 forwardly. Spring plate 56, in turn, biases blocking member 54 forwardly. As shown in FIG. 7, the forward biasing of blocking member 54 allows a pair of lugs 174 on blocking member 54 to snap into the respective lug-receiving recesses 164 in track 52 as blocking member 54 arrives at the lever-blocking position. Lugs 174 are sometimes referred to herein as the detents, teeth, or locking portions. Recesses 164 are sometimes referred to herein as the cutouts or pockets.

Figure 5:
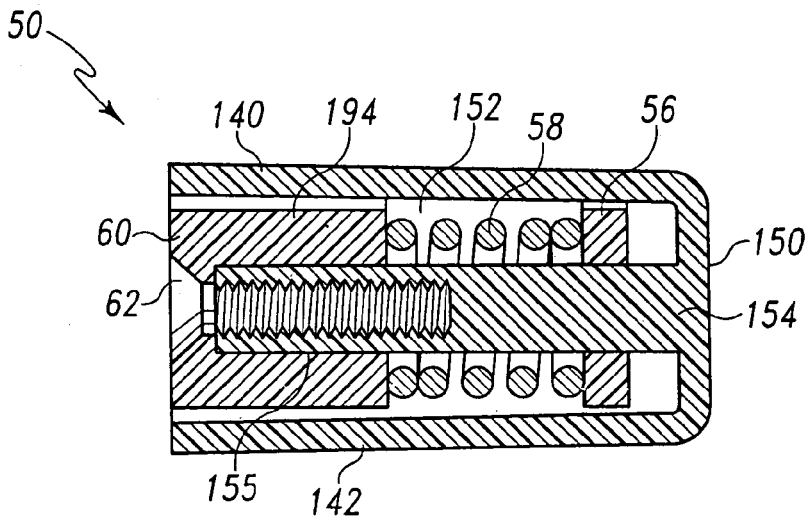
FIG. 5 is a partial sectional view of the door lock taken along line 5—5 of FIG. 3 showing the spring plate mounted for movement in the housing and pushed inwardly, the rear cover plate being secured to the housing, and a spring extending between the spring plate and the rear cover plate to bias the spring plate forwardly.
Figure 8:
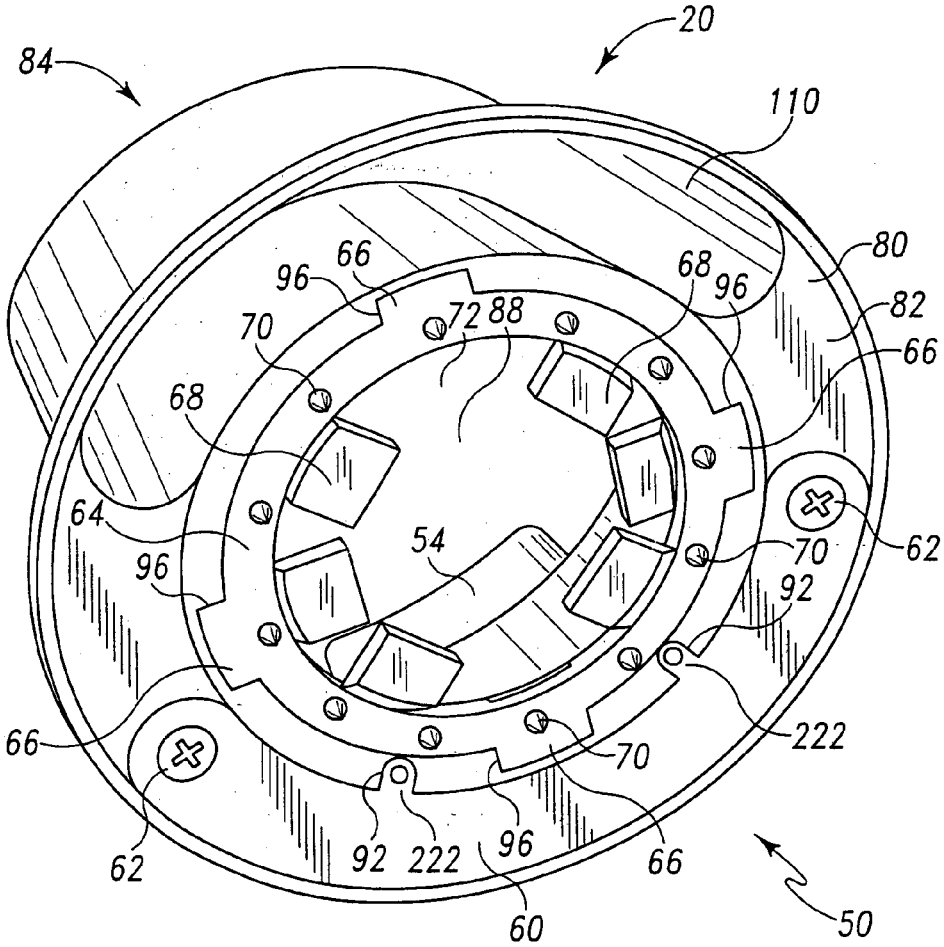
FIG. 8 a rear perspective view of the door lock showing the rear cover plate and the mounting plate secured to the housing.

As shown in FIGS. 5 and 7, retaining screws 62 secure rear cover plate 60 to a rearwardly facing door-mount surface 82 of housing 50. As shown in FIG. 8, mounting plate 64 has four outwardly extending tabs 66 that are arranged to seat in the respective slots 96 provided in housing 50 to releasably secure mounting plate 64 to housing 50. Mounting plate 64 has thirty-two inwardly extending knock-out tabs 68 that are arranged to extend between escutcheon plate 28 and door 24 to anchor door lock 20 to escutcheon plate 28 of door handle assembly 22. Some of knock-out tabs 68 are rectangle-shaped and others of tabs 68 are pie-shaped in the illustrated embodiment.

Door lock 20 is anchored to escutcheon plate 28 using the same mounting screws 30 that are used for mounting door handle assembly 22 to door 24. If mounting screws 30 of door handle assembly 22 are located at 6 o'clock and 12 o'clock positions, one or more knock-out tabs 68 at the corresponding 6 o'clock and 12 o'clock positions on mounting plate 64 are removed as shown in FIG. 8, so that mounting screws 30 can be driven into door 24 through the space vacated by these knocked-out tabs 68 at the 6 o'clock and 12 o'clock positions. On the other hand, if the mounting screws 30 are located at 3 o'clock and 9 o'clock positions, one or more knock-out tabs 68 at the corresponding 3 o'clock and 9 o'clock positions on mounting plate 64 are removed, so that mounting screws 30 can be driven into door 24 through the space vacated by these knock-out tabs 68 at the 3 o'clock and 9 o'clock positions.

Referring to FIGS. 1–8, housing 50 includes an annular (e.g., ring-shaped) base portion 80 having a rearwardly-facing door-mount surface 82, an arcuate upper flange 84 extending forwardly from base portion 80, and an arcuate lower flange 86 also extending forwardly from base portion 80. Upper and lower flanges 84, 86 are sometimes referred to herein as cantilevered portions 84, 86. Annular base portion 80 includes a central bore 88 through which hub 38 of door handle 26 extends when door lock 20 is mounted on door handle 26. When assembled, a longitudinal axis 90 (see FIG. 4) of central bore 88 aligns with axis 36 of hub 38.

Figure 4:
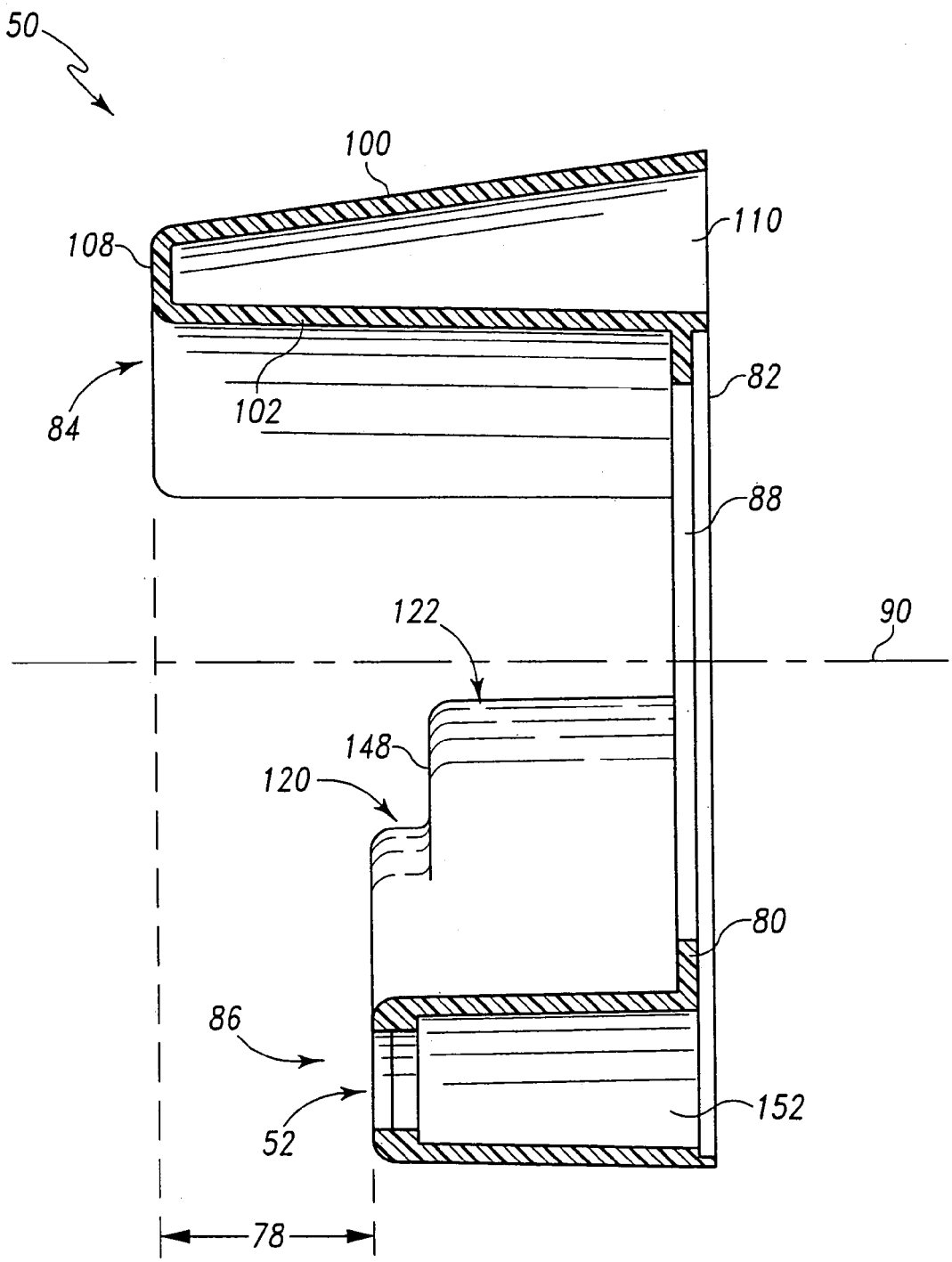
FIG. 4 is a sectional view of the housing taken along line 4—4 of FIG. 3.

As shown in FIG. 8, annular base portion 80 has four slots 96 into which outwardly extending tabs 66 of mounting plate 64 are received to releasably secure mounting plate 64 to housing 50. Upper and lower flanges 84, 86 are disposed on the opposite sides of central bore 88. The centerlines of upper and lower flanges 84, 86 are located at about 12 o'clock and 6 o'clock positions. As shown in FIG. 4, upper flange 84 extends forwardly some distance beyond lower flange 86 (indicated by numeral 78) so that the front surfaces of upper flange 84 and blocking member 54 mounted in lower flange 86 are generally aligned upon assembly.

Upper flange 84 provides a protective shield or visor to door handle assembly 22 as suggested in FIGS. 1 and 2 and is arranged to provide a fixed lever-blocking member arranged to block upward movement of lever 34 in counterclockwise direction 74. Upper flange 84 includes two forwardly extending side walls 100, 102, two forwardly extending end walls 104, 106 extending between the end portions of the side walls 100, 102 and a laterally extending front wall 108 extending between the front portions of side walls 100, 102 and end walls 104, 106. Side wall 100 defines a convex surface and side wall 102 defines a concave surface. Front wall 108, side walls 100, 102, and end walls 104, 106 form a rearwardly facing blind cavity 110 which is closed at the front end by front wall 108. As shown in FIG. 4, upper side wall 100 slopes somewhat downwardly so that the vertical spacing between side walls 100,102 diminishes as the upper flange 84 extends forwardly. End wall 106 is arranged to engage (and block further rotation of) lever 34 if a user rotates lever 34 in a counterclockwise direction 74 about pivot axis 36.

Lower flange 86 includes a head portion 120 and a base portion 122. Head portion 120 includes two forwardly extending side walls 130, 132 and two forwardly extending end walls 134, 136 extending between the end portions of the side walls 130, 132. Base portion 122 includes two forwardly extending side walls 140, 142, two forwardly extending end walls 144, 146 extending between the end portions of side walls 140, 142, and a pair of laterally-extending front walls 148, 150 on the opposite sides of head portion 120. Front walls 148, 150 of base portion 122 define two oppositely-disposed shoulder or seat portions at the junction of head and base portions 120, 122 of lower flange 86.

Referring to FIGS. 1 and 2, side walls 130, 132 and end walls 134, 136 of the head portion 120 define the forwardly facing arcuate track 52 in which blocking member 54 is mounted for side-to-side movement and for axial movement toward and away from door 24. Side walls 130, 132 and end walls 134, 136 of head portion 120 have inwardly-extending lip portions 131, 133, 135, and 137, respectively. As shown in FIG. 6, the spacing between inwardly extending lip portions 131, 133 of the side walls 130, 132 is slightly greater than the width of the head portion 170 of blocking member 54 to allow blocking member 54 to slide freely in arcuate track 52 between the lever-blocking and lever-releasing positions. However, the spacing between inwardly extending lip portions 131, 133 of side walls 130, 132 is smaller than the width of the slightly wider base portion 172 of blocking member 54 to retain blocking member 54 in arcuate track 52. Although track 52 is arcuate in the illustrated embodiment, it may very well be linear. Also, track 52 may be in the form of a rail, instead of a channel. Further, blocking member 54 may be supported on a member which is movable relative to housing 50 (e.g., pivotally mounted on housing 50).

Side walls 140, 142, end walls 144, 146, and front walls 148, 150 of base portion 122 define a rearwardly facing arcuate cavity 152 as shown in FIGS. 4–6. The rearwardly facing arcuate cavity 152 is closed at both ends by front walls 148, 150. Rearwardly facing arcuate cavity 152 is in communication with the forwardly facing arcuate track 52 where head and base portions 120, 122 of lower flange 86 meet. Blocking member 54, arcuate track 52, and arcuate cavity 152 have the same curvature or profile as viewed from the front.

Spring plate 56 is mounted in the rearwardly facing arcuate cavity 152 behind blocking member 54 for slidable movement toward and away from door 24 as shown in FIG. 6. Spring plate 56 extends the full length of the rearwardly facing arcuate cavity 152, but has a "footprint" that is slightly smaller than the footprint of the rearwardly facing arcuate cavity 152 so that spring plate 56 can slide freely in cavity 152.

Two cylindrical guide posts 154 extend rearwardly from the rearwardly facing surfaces of front walls 148, 150 of base portion 122 as shown in FIG. 5. Guide posts 154 are slidably received in respective openings 184 in spring plate 56 to stabilize spring plate 56 as it slides in cavity 152. Guide posts 154 have threaded bores 155 into which the screw portions of mounting screws 62 are threaded to secure rear cover plate 60 to housing 50.

Four springs 58 extend between spring plate 56 and rear cover plate 60 to bias spring plate 56 forwardly as shown in FIGS. 5 and 6. Upon assembly, the rearwardly facing surface of base portion 172 of blocking member 54 engages the forwardly-facing surface of spring plate 56 to bias blocking member 54 forwardly. The slightly wider base portion 172 of blocking member 54 abuts against inwardly extending lip portions 131, 133 of side walls 130, 132 except when blocking member 54 is pushed inwardly against spring plate 56 (for example, to move blocking member 54 from the blocking position to the releasing position). Inwardly extending lip portions 131, 133 of side walls 130, 132 of head portion 120 of lower flange 86 are provided with rearwardly facing recesses 164 as shown, for example, in FIG. 7. Forwardly extending lugs 174 in base portion 172 of blocking member 54 snap into rearwardly facing recesses 164 as blocking member 54 arrives at the blocking position to prevent blocking member 54 from moving sideways.

Blocking member 54 includes head portion 170 and slightly wider base portion 172. Blocking member 54 includes a ledge or a step at the junction of head and base portions 170, 172 which engages inwardly extending lip portions 131, 133 of track 52 to retain blocking member 54 in track 52. Head and base portions 170, 172 of blocking member 54 are sometimes referred to as the finger-engaging portion 170 and the locking portion 172, respectively.

Illustratively, arcuate track 52 extends from about 4 o'clock position to about 8 o'clock position. For a door handle assembly having a "right-handed" lever, the centerlines of blocking member 54, recesses 164 in arcuate track 52, and lugs 174 on blocking member 54 are positioned at about 5 o'clock position when blocking member 54 is in the lever-blocking position shown in FIG. 1. On the other hand, for a door handle assembly having a "left-handed" lever, the centerlines of blocking member 54, recesses 164, and lugs 174 are located at about 7 o'clock position when blocking member 54 is in the lever-blocking position on the opposite side of door handle assembly 22. For both the right-handed and left-handed levers, the centerlines of blocking member 54, recesses 164, and lugs 174 are at about 6 o'clock position when blocking member 54 is in the lever-releasing position shown in FIG. 2.

Spring plate 56 has two oppositely-disposed openings 184 near the ends thereof into which the respective rearwardly extending guide posts 154 in housing 50 are slidably received as shown in FIG. 5. In addition, spring plate 56 has two cylindrical guide posts 188 that extend rearwardly from the rearwardly-facing surface of spring plate 56. Guide posts 188 of spring plate 56 are slidably received in the respective openings 218 in rear cover plate 60.

Rear cover plate 60 has two forwardly-extending cylindrical bosses 194 near the ends thereof. Cylindrical bosses 194 are provided with respective central bores 204. In addition, rear cover plate 60 has two forwardly extending non-cylindrical bosses 208 (or cylindrical bosses with reinforcement ribs) in the midsection thereof. Non-cylindrical bosses 208 are provided with respective central bores 218. As shown in FIG. 8, rear cover plate 60 has two locating tabs 222 in the midsection thereof which are configured to be received in complementary tab-receiving cutouts 92 in annular base portion 80 of housing 50 to position rear cover plate 60 with respect to housing 50. As shown in FIG. 5, the screw portions of mounting screws 62 are threaded into threaded bores 155 formed in guide posts 154 to secure rear cover plate 60 to housing 50.

As shown in FIG. 5, rearwardly extending guide posts 154 in housing 50 are configured to extend through openings 184 in spring plate 56, and then extend through central bores 204 in cylindrical bosses 194 in rear cover plate 60. In addition, cylindrical guide posts 188 in spring plate 56 are configured to extend through central bores 218 in non-cylindrical bosses 208 in rear cover plate 60. Slidable reception of guide posts 154 in the respective openings 184 in spring plate 56 and the reception of rearwardly extending guide posts 188 in the respective openings 218 in rear cover plate 60 provide stabilization to spring plate 56 as it slides in cavity 152 toward and away from door 24.

Referring to FIG. 3, mounting plate 64 has four outwardly-extending tabs 66 which are located at 3 o'clock, 6 o'clock, 9 o'clock, and 12 o'clock positions. As shown in FIG. 8, outwardly extending tabs 66 of mounting plate 64 seat in the respective slots or cavities 96 in annular base portion 80 of housing 50 to releasably secure mounting plate 64 to housing 50. Mounting plate 64 has thirty-two symmetrically-spaced pairs of inwardly-extending knock-out tabs 68. Eight pairs of knock-out tabs 68 have a generally rectangular shape, and eight pairs of knock-out tabs 68 have a generally triangular shape. The rectangular and triangular tabs 68 are alternately arranged along the inner periphery of mounting plate 64 as shown. The inner edges of inwardly extending tabs 68 of mounting plate 64 cooperate to form a circumferentially continuous surface which is configured to engage hub 38 of door handle 26 to position door lock 20. In addition, inwardly extending tabs 68 extend between escutcheon plate 28 and door 24 to releasably secure housing 50 to door 24. Mounting plate 64 has a central bore 72.

Door lock 20 can be anchored readily to escutcheon plate 28 using the same mounting screws 30 that are used for mounting door handle assembly 22 to door 24. If the mounting screws 30 are located at 6 o'clock and 12 o'clock positions, a couple of knock-out tabs 68 at the corresponding 6 o'clock and 12 o'clock positions on mounting plate 64 are removed as shown in FIG. 8, so that mounting screws 30 can be driven into door 24 through the space vacated by these knock-out tabs 68 which are removed. Likewise, if the mounting screws 30 are located at 3 o'clock and 9 o'clock positions, a couple of knock-out tabs 68 at the corresponding 3 o'clock and 9 o'clock positions on mounting plate 64 are removed, so that mounting screws 30 can be driven into door 24 through the space vacated by these knock-out tabs 68 which are removed.

As shown in FIG. 8, the rearwardly facing surface of mounting plate 64 has a plurality of circumferentially-arranged dimples 70 (e.g., twelve in the illustrated embodiment). Mounting screws 30 press dimples 70 against door 24 so that housing 50 is prevented from rotating when blocking member 54 is in the lever-blocking position and lever 34 is pressed against blocking member 54. Although the illustrated embodiment of mounting plate 64 has four outwardly-extending tabs 66, sixteen pairs of inwardly-extending tabs 66, and twelve dimples 70, a different number of outwardly and inwardly-extending tabs 64, 66, and dimples 70 may be provided.

The assembly of various components will now be explained with reference to FIGS. 1–3. The components are generally assembled in the following order, although it is not necessary to assemble them in this order. Blocking member 54 is mounted in arcuate track 52 from the back side through the rearwardly-facing cavity 152 such that the slightly wider base portion 172 of blocking member 54 engages inwardly extending lip portions 131, 133 of track 52.

Spring plate 56 is mounted in cavity 152 behind blocking member 54 such that rearwardly extending guide posts 154 in housing 50 pass though openings 184 in spring plate 56. A first pair of springs 58 are mounted such that two guide posts 154 extend through the respective openings in the first pair of springs 58. A second pair of springs 58 are mounted such that two rearwardly extending guide posts 188 of spring plate 56 extend through the respective openings in the second pair of springs 58.

Rear cover plate 60 is then installed such that guide posts 154 in housing 50 pass through openings 204 in cylindrical bosses 194, guide posts 188 on spring plate 56 pass through the respective openings 218 in non-cylindrical bosses 208, and locating tabs 222 in rear cover plate 60 are received in complementary tab-receiving recesses 92 in annular base portion 80 of housing 50. Mounting screws 62 are then screwed into threaded bores 155 in guide posts 154 to secure rear cover plate 60 to housing 50.

Upon assembly of rear cover plate 60, four springs 58 bias spring plate 56 forwardly, and spring plate 56, in turn, biases blocking member 54 forwardly. Mounting plate 64 is then assembled by inserting outwardly extending tabs 66 therein in the complementary slots 96 in housing 50.

Door handle 26 and escutcheon plate 28 are removed from door 24 prior to installation of door lock 20 on door handle 26. One of inwardly extending tabs 68 is removed to make space for mounting screws 30. Door lock 20 is then slipped over the inner shaft (not shown) of latch mechanism 32 so that the inner shaft of latch mechanism 32 extends through central bores 72, 88 in mounting plate 64 and housing 50. Door handle 26 and escutcheon plate 28 are then secured to door 24 by mounting screws 30 such that inwardly-extending tabs 68 of mounting plate 64 are received between escutcheon plate 28 and door 24.

Door lock 20 can be installed as described without drilling or forming new holes in door 24. Door lock 20 works with right- or left-handled levers 34 and cannot self-lock. Fixed blocking member 84 bars an unauthorized user from "lifting" lever 34 (i.e., pivoting lever 34 in counterclockwise direction 74) to open door 24.

Although the disclosure has been described herein in detail with reference to certain preferred embodiments, additional variations and modifications exist within the scope and spirit of the disclosure as described and defined in the following claims.

The invention claimed is:

1. A lock for use with a door handle assembly mounted on a door and including a lever movable about a shaft extending generally perpendicularly to the lever and connected to a latch mechanism which controls the opening and closing of the door, the lock comprising a housing adapted to be coupled to the door handle assembly, and a blocking member movable relative to the housing between a blocking position preventing movement of the lever to inhibit opening of the door and a releasing position permitting movement of the lever to allow opening of the door, wherein the blocking member is movable in a track toward and away from the door between a raised position away from the door where the blocking member is prevented from laterally moving in the track and a depressed position toward the door where the blocking member is free to move laterally in the track between the blocking position and releasing position.

2. The lock of claim 1, wherein the blocking member has a lug, the track includes a lug-receiving recess at a position of the blocking member corresponding to the blocking position, and the lug is configured to extend into the recess when the blocking member is disposed in the blocking position to prevent lateral movement of the blocking member in the track.

3. A lock for use with a door handle assembly mounted on a door and including a lever movable about a shaft extending generally perpendicularly to the lever and connected to a latch mechanism which controls the opening and closing of the door, the lock comprising a housing adapted to be coupled to the door handle assembly, and a blocking member movable relative to the housing between a blocking position preventing movement of the lever to inhibit opening of the door and a releasing position permitting movement of the lever to allow opening of the door, wherein the blocking member is movable in the track toward and away from the door between a raised position where the blocking member is prevented from laterally moving in the track and a depressed position where the blocking member is free to move laterally in the track between the blocking position and releasing position wherein the blocking member has a lug, the track includes a lug-receiving recess at a position of the blocking member corresponding to the blocking position, and the lug is configured to extend into the recess when the blocking member is disposed in the blocking position to prevent lateral movement of the blocking member in the track including a spring arranged to bias the blocking member away from the door so that the lug snaps into the recess in the track as the blocking member arrives at the blocking position.

4. The lock of claim 3, wherein the blocking member is pushed inwardly against the spring to cause the lug to disengage from the recess so that the blocking member is free to move in the track to the releasing position.

5. A lock for use with a door handle assembly mounted on a door and including a lever movable about a shaft extending generally perpendicularly to the lever and connected to a latch mechanism which controls the opening and closing of the door, the lock comprising a housing adapted to be coupled to the door handle assembly, a blocking member movable relative to the housing between a blocking position extending a first distance away from the door and preventing movement of the lever to inhibit opening of the door and a releasing position extending a second distance less than the first distance away from the door and permitting movement of the lever to allow opening of the door, wherein the movable blocking member is arranged to prevent movement of the lever in a first direction upon movement to the blocking position, and a fixed blocking member coupled to the housing and arranged to prevent movement of the lever in a second direction opposite to the first direction to inhibit opening of the door, wherein the lever is arranged to lie in a space located between the movable and fixed blocking members.

6. A lock for use with a door handle assembly mounted on a door and including a lever movable about a shaft extending generally perpendicularly to the lever and connected to a latch mechanism which controls the opening and closing of the door, the lock comprising a housing adapted to be coupled to the door handle assembly, a blocking member movable relative to the housing between a blocking position preventing movement of the lever to inhibit opening of the door and a releasing position permitting movement of the lever to allow opening of the door, wherein the movable blocking member is arranged to prevent movement of the lever in a first direction upon movement to the blocking position, and a fixed blocking member coupled to the housing and arranged to prevent movement of the lever in a second direction opposite to the first direction to inhibit opening of the door, wherein the fixed blocking member has a curved shape.

7. The lock of claim 6, wherein the movable blocking member has a curved shape and a concave surface arranged to face toward a concave surface included in the fixed blocking member.

8. A lock for use with a door handle assembly mounted on a door, the door handle assembly including a door handle having a lever movable about a hub and an escutcheon plate configured to be secured to the door, the lock comprising a housing adapted to be coupled to the door handle assembly, a blocking member mounted for movement relative to the housing between a blocking position preventing movement of the lever to inhibit opening of the door and a releasing position permitting movement of the lever to allow opening of the door, and a mounting plate configured to be coupled to the housing, the mounting plate having a portion configured to extend between the escutcheon plate and the door to secure the housing to the door handle assembly, wherein the housing has a track, the blocking member is movable relative to the track between the blocking and releasing positions, the track is arcuate, the arcuate track extends from about 4 o'clock position to about 8 o'clock position, and the housing includes an arcuate guard that extends from about 10 o'clock position to about 2 o'clock position.

9. A lock for use with a door handle assembly mounted on a door, the door handle assembly including a door handle having a lever movable about a hub and an escutcheon plate configured to be secured to the door, the lock comprising a housing adapted to be coupled to the door handle assembly, a blocking member mounted for movement relative to the housing between a blocking position preventing movement of the lever to inhibit opening of the door and a releasing position permitting movement of the lever to allow opening of the door, and a mounting plate configured to be coupled to the housing, the mounting plate having a portion configured to extend between the escutcheon plate and the door to secure the housing to the door handle assembly, wherein the housing and the mounting plate each have a central bore through which the hub of the door handle assembly extends when the lock is mounted to the door handle assembly, the mounting plate has a plurality of outwardly-extending tabs configured to secure the mounting plate to the housing, and the mounting plate has a plurality of inwardly-extending tabs configured to extend between the escutcheon plate and the door to secure the housing to the door handle assembly.

10. The lock of claim 9, wherein the inner walls of the inwardly-extending tabs are configured to engage the hub of the door handle assembly to position the housing relative to the door handle assembly.

11. The lock of claim 9, wherein the door handle assembly includes at least one mounting screw to secure the escutcheon plate to the door, and one or more inwardly-extending tabs corresponding to the position of the mounting screw are removed to make space through which the mounting screw is driven into the door so that the mounting screw can be driven through the space vacated by the inwardly-extending tabs to secure the escutcheon plate to the door with the remaining inwardly-extending tabs held between the escutcheon plate and the door.

12. A lock for use with a door handle assembly mounted on a door and including a door handle having a proximal hub portion concentric with an axis extending perpendicularly from the door and a laterally-extending grip portion movable about the axis, the lock selectively blocking movement of the handle comprising a housing adapted to be coupled to the door handle assembly and having a track, and a blocking member movable relative to the track between a blocking position preventing movement of the grip portion to inhibit opening of the door and a releasing position permitting movement of the grip portion to allow opening of the door, wherein the track is a channel, the blocking member is mounted in the channel for movement between the blocking and releasing positions, the channel is arcuate, the laterally-extending grip portion extends to the right hand side, the arcuate track extends from about 4 o'clock position to about 8 o'clock position, and the centerline of the blocking member is at about 5 o'clock position when the blocking member is disposed in the blocking position.

13. The lock of claim 12, wherein the centerline of the blocking member is at about 6 o'clock position when the blocking member is in the releasing position.

14. A lock for use with a door handle assembly mounted on a door and including a door handle having a proximal hub portion concentric with an axis extending perpendicularly from the door and a laterally-extending grip portion movable about the axis, the lock selectively blocking movement of the handle comprising a housing adapted to be coupled to the door handle assembly and having a track, and a blocking member movable relative to the track between a blocking position preventing movement of the grip portion to inhibit opening of the door and a releasing position permitting movement of the grip portion to allow opening of the door, wherein the track is a channel, the blocking member is mounted in the channel for movement between the blocking and releasing positions, the channel is arcuate, the laterally-extending grip portion extends to the left hand side, the arcuate track extends laterally from about 4 o'clock position to about 8 o'clock position, and the centerline of the blocking member is at about 7 o'clock position when the blocking member is in the blocking position.

15. The lock of claim 14, wherein the centerline of the blocking member is at about 6 o'clock position when the blocking member is in the releasing position.

16. A lock for use with a door handle assembly mounted on a door and including a door handle having a proximal hub portion concentric with an axis extending perpendicularly from the door and a laterally-extending grip portion movable about the axis, the lock selectively blocking movement of the handle comprising a housing adapted to be coupled to the door handle assembly and having a track, a blocking member movable relative to the track between a blocking position preventing movement of the grip portion to inhibit opening of the door and a releasing position permitting movement of the grip portion to allow opening of the door, and a spring plate mounted in the track for movement toward and away from the door when the lock is mounted on the door and a spring biasing the spring plate away from the door and wherein the spring plate biases the blocking member away from the door.

17. The lock of claim 16, further comprising a rear cover plate configured to be coupled to the housing and wherein the spring extends between the spring plate and the rear cover plate to bias the spring plate away from the rear cover plate.

18. A lock for use with a door handle assembly mounted on a door and including a door handle having a proximal hub portion concentric with an axis extending perpendicularly from the door and a laterally-extending grip portion movable about the axis, the lock selectively blocking movement of the handle comprising a housing adapted to be coupled to the door handle assembly and having a track, a blocking member movable relative to the track between a blocking position preventing movement of the grip portion to inhibit opening of the door and a releasing position permitting movement of the grip portion to allow opening of the door, a spring plate mounted in the track for movement toward and away from the door when the lock is mounted on the door, a spring biasing the spring plate away from the door when the lock is mounted on the door, wherein the spring plate biases the blocking member away from the door, and a rear cover plate configured to be coupled to the housing, wherein the spring extends between the spring plate and the rear cover plate to bias the spring plate away from the rear cover plate, the door handle assembly includes an escutcheon plate configured to be coupled to the door, the lock includes a mounting plate configured to be coupled to the housing, the housing and the mounting plate each have a central bore through which the hub portion of the door handle assembly extends when the lock is mounted to the door handle assembly, the mounting plate has a plurality of outwardly-extending mounting tabs configured to secure the mounting plate to the housing, and the mounting plate has a plurality of inwardly-extending mounting tabs configured to extend between the escutcheon plate and the door to secure the housing to the door.

19. The lock of claim 18, wherein the inner walls of the inwardly-extending mounting tabs are configured to engage the hub portion of the door handle assembly to position the lock relative to the door handle assembly.

20. The lock of claim 18, wherein the plurality of outwardly-extending mounting tabs comprise four outwardly-extending tabs, and the plurality of inwardly-extending mounting tabs comprise thirty-two inwardly-extending knock-out tabs.

21. The lock of claim 18, wherein the door handle assembly includes at least one mounting screw to secure the escutcheon plate to the door and one or more inwardly-extending tabs corresponding to the position of the mounting screw are removed to make space through which the mounting screw is driven into the door.

* * * * *